US007121704B2

(12) United States Patent
Takada

(10) Patent No.: US 7,121,704 B2
(45) Date of Patent: Oct. 17, 2006

(54) VEHICLE HEADLAMP

(75) Inventor: Kenichi Takada, Shizouka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 178 days.

(21) Appl. No.: 10/755,477

(22) Filed: Jan. 13, 2004

(65) Prior Publication Data

US 2004/0141330 A1 Jul. 22, 2004

(30) Foreign Application Priority Data

Jan. 16, 2003 (JP) ..... P. 2003-008914

(51) Int. Cl.
*F21V 7/00* (2006.01)

(52) U.S. Cl. ..... 362/516; 362/298; 362/302; 362/346

(58) Field of Classification Search ..... 362/298, 362/302, 346, 507, 514, 516–518, 538–539
See application file for complete search history.

(56) References Cited

U.S. PATENT DOCUMENTS 1,462,036 A * 7/1923 de Leon Graham ..... 362/298
1,525,234 A * 2/1925 de Leon Graham ..... 362/298
1,603,253 A * 10/1926 Appel ..... 362/300
1,775,619 A * 9/1930 Whalen ..... 362/302
4,800,467 A * 1/1989 Lindae et al. ..... 362/539
5,083,243 A * 1/1992 Paulat et al. ..... 362/544

FOREIGN PATENT DOCUMENTS

JP 2558801 Y2 9/1997
JP 2002-175709 A 6/2002
WO WO 91/02666 * 3/1991

* cited by examiner

*Primary Examiner*—Thomas M. Sember
*Assistant Examiner*—Adam C. Rehm
(74) *Attorney, Agent, or Firm*—Sughrue Mion, PLLC

(57) ABSTRACT

A pair of additional reflectors are disposed face to face under a light source. The reflective surfaces of the respective additional reflectors are formed of paraboloids of revolution, with the first focal point of the reflective surface of a reflector as a focal point, and with an optical axis as the central axis of the revolution. As a result, retroreflective light from both reflectors is incident on the upper reflective region of the reflector. Thus, the spreading of the retroreflective light can be reduced based on the enhanced efficiency of utilizing the luminous flux of the light source, to the extent of the presence of the retroreflective light, as compared with the related art structure, wherein a spherical reflective surface centering on the light source is provided.

20 Claims, 16 Drawing Sheets

VEHICLE HEADLAMP

BACKGROUND OF THE INVENTION

This application claims benefit and priority from the following application: Japanese Patent Application No. P2003-008914, filed Jan. 16, 2003, the contents of which is incorporated herein by reference.

1. Field of the Invention

The present invention relates to a vehicle headlamp arranged to emit low beams of light, using a projector type lighting device unit.

2. Background of the Related Art

In the related art, vehicle headlamps for emitting light forward from vehicles use projector type lighting device units. The related art projector type lighting device unit is designed to converge rays of light from a light source disposed on an optical axis extending in the longitudinal direction of a vehicle closer to the optical axis, and to reflect the light forward by means of a reflector. As a result, the reflected light is emitted in the forward direction of a lighting device through a projection lens installed in front of the reflector.

When the projector type lighting device unit is used as a lighting device unit for emitting low beams of light, a shade is provided between the projection lens and the reflector to shield part of rays of the light reflected from the reflector.

In connection with the foregoing related art arrangement, related art JP-Y2-2558801 (Japanese Registered Utility Model Publication Number: 2558801), the contents of which is incorporated herein by reference, discloses a projector type lighting device unit for emitting low beams of light. The projector type lighting unit includes a shade having a spherical reflective surface centering on a light source formed on the back side of the shade. Additional related art, the contents of which is also incorporated herein by reference, includes JP-A-2002-175709 (Japanese Application Publication Number: 2002-175709), and U.S. Pat. No. 4,800,467.

In such a related art projector type lighting device unit for emitting low beams of light, most of the light reflected in the lower reflective region of the reflector and directed to the projection lens is shielded by the shade. Therefore, a related art problem arises from low efficiency in utilizing the luminous flux of the light source.

However, as described in the above-identified JP-Y2-2558801 reference, light incident on a spherical reflective surface formed on the back side of the shade from the light source is sent back to the position of the light source, whereby the retroreflective light can be utilized as light incident on the upper reflective region of the reflector.

Since the light source has a fixed size, the retroreflective light from the spherical reflective surface spreads considerably, as compared with direct light from the light source. Therefore, a luminous distribution pattern formed by the retroreflective light reflected in the upper reflective region of the reflector becomes less uniform in the luminous intensity distribution.

Accordingly, the foregoing related art has various problems and disadvantages. For example, but not by way of limitation, light distribution control utilizing the retroreflective light is performs extremely poorly.

SUMMARY OF THE INVENTION

It is an object to overcome at least the problems and disadvantages of the related art. However, it is not necessary for the present invention to overcome the related problems and disadvantages, or any other problems or disadvantages, as an object thereof.

An object of the invention made in view of the foregoing related art problems is to provide a vehicle headlamp employing a projector type lighting device unit for emitting low beams of light such that light distribution control is readily performable upon enhancing efficiency in utilizing the luminous flux of a light source.

To accomplish the foregoing objects, a pair of additional reflectors respectively having reflective surfaces as prescribed are disposed face to face under a light source.

According to the present invention, a vehicle headlamp has a lighting device unit for emitting low beams of light. The lighting device unit comprises a light source disposed on an optical axis extending in the longitudinal direction of a vehicle, a reflector for converging rays of light from the light source closer to the optical axis and reflecting the rays of light forward, a projection lens provided in front of the reflector, a shade provided between the projection lens and the reflector and used for shielding part of the light reflected from the reflector, and a pair of additional reflectors disposed face to face under the light source.

More specifically, the reflective surfaces of the respective additional reflectors are formed of paraboloids of revolution, with the position of the light source as a substantially focal point, and with a common axis extending in a predetermined direction as the central axis of revolution.

The above-described 'light source' is not particularly limited in kind. However, the discharge light emitting portion of a discharge bulb and the filament of a halogen bulb, for example but not by way of limitation, can be employed.

As long as the above described 'pair of additional reflectors' are disposed face to face under the light source, no limitations are imposed on the arrangement of the additional reflectors in terms of defining directions of both additional reflectors and the focal distance of each paraboloid of revolution for forming the reflective surfaces of the additional reflectors.

The above described 'position of the light source as a substantially focal point' means that the focal point is positioned in or substantially near the light source.

With the arrangement above, though the vehicle headlamp according to the invention is made to emit low beams of light, using the projector type lighting device unit having the shade, the pair of additional reflectors is disposed face to face under the light source. As the reflective surfaces of the respective additional reflectors are formed of paraboloids of revolution with the position of the light source as a substantially focal point and with a common axis extending in a predetermined direction as the central axis of revolution, the following operation/working effect is achievable.

More specifically, light from the light source incident on a first additional reflector which is one of the pair of additional reflectors, is reflected from the first additional reflector, incident on a second additional reflector, reflected from the second additional reflector as retroreflective light directed to the position of the light source, and then incident on the upper reflective region of the reflector.

On the other hand, light from the light source incident on the second additional reflector is reflected from the second additional reflector, incident on the first additional reflector, reflected from the first additional reflector as retroreflective light directed to the position of the light source, and then incident on the upper reflective region of the reflector.

At this time, since the reflective surfaces of the additional reflectors are formed of the paraboloids of revolution, the spreading of retroreflective light from both additional reflectors is narrower than the related art spreading of retroreflective light from a spherical reflective surface centering on the light source.

In other words, light from the light source incident on one point of the first additional reflector is reflected from the point at the same spreading angle as the estimated spreading angle of light from the light source, and incident again on the second additional reflector. However, the light reflected from the second additional reflector is the light directed to the position of the light source at a spreading angle substantially narrower than the spreading angle of the light reflected from the first additional reflector. The foregoing is also accurate when light from the light source is incident on the second additional reflector, reflected to the first additional reflector, and reflected from the first additional reflector direct to the position of the light source.

On the other hand, in the related art, light from the light source incident on one point of the spherical reflective surface centering on the light source becomes the light directed from the point to the position of the light source at substantially the same spreading angle as the estimated spreading angle of light from the light source. Consequently, the spreading of retroreflective light from both additional reflectors becomes narrower than the spreading of retroreflective light from the spherical reflective surface. Thus, the luminous distribution pattern formed by the retroreflective light reflected from the upper reflective region of the reflector becomes uniform in luminous intensity distribution as compared with the spherical reflective surface, whereby light distribution control utilizing retroreflective light is readily performable.

Further, efficiency in utilizing the luminous flux of the light source is increased by providing the pair of additional reflectors to the extent of the presence of retroreflective light from both additional reflectors as compared with the lighting device unit without having these additional reflectors.

Thus, upon enhancing efficiency in utilizing the luminous flux, light distribution control can readily be performed in the vehicle headlamp for emitting low beams of light by means of the projector type lighting device unit according to the invention.

With the arrangement described above, no limitations are imposed on defining the directions of the pair of additional reflectors as described above. Thus, it is possible to precisely set each position where the retroreflective light is incident on the reflector with respect to the longitudinal direction by disposing both additional reflectors face to face with respect to the longitudinal direction. Accordingly, control of the longitudinal spreading of the additional luminous distribution pattern formed by the retroreflective light reflected from the upper reflective region of the reflector can readily be performed.

On the other hand, it is also possible to precisely set each position where the retroreflective light is incident on the reflector with respect to the lateral direction, by disposing the pair of additional reflectors face to face with respect to the lateral direction. Accordingly, control of the lateral spreading of the additional luminous distribution pattern formed by the retroreflective light reflected from the upper reflective region of the reflector can readily be performed.

In additional to the arrangements described above, if two sets of the pair of additional reflectors are disposed substantially orthogonally, each position where the retroreflective light is incident on the reflector can precisely be set with respect to the longitudinal and lateral directions. Accordingly, control of the longitudinal as well as lateral spreading of the luminous distribution pattern formed by the retroreflective light reflected from the upper reflective region of the reflector can readily be performed.

BRIEF DESCRIPTION OF THE DRAWINGS

The above and other objects and advantages of the present invention will become more apparent by describing in detail exemplary, non-limiting embodiments thereof with reference to the accompanying drawings, wherein like reference numerals designate like or corresponding parts throughout the several views, and wherein.

DESCRIPTION OF THE PREFERRED EMBODIMENT

Embodiments of the present invention will now be described by reference to the drawings.

First Embodiment

Figure 1:
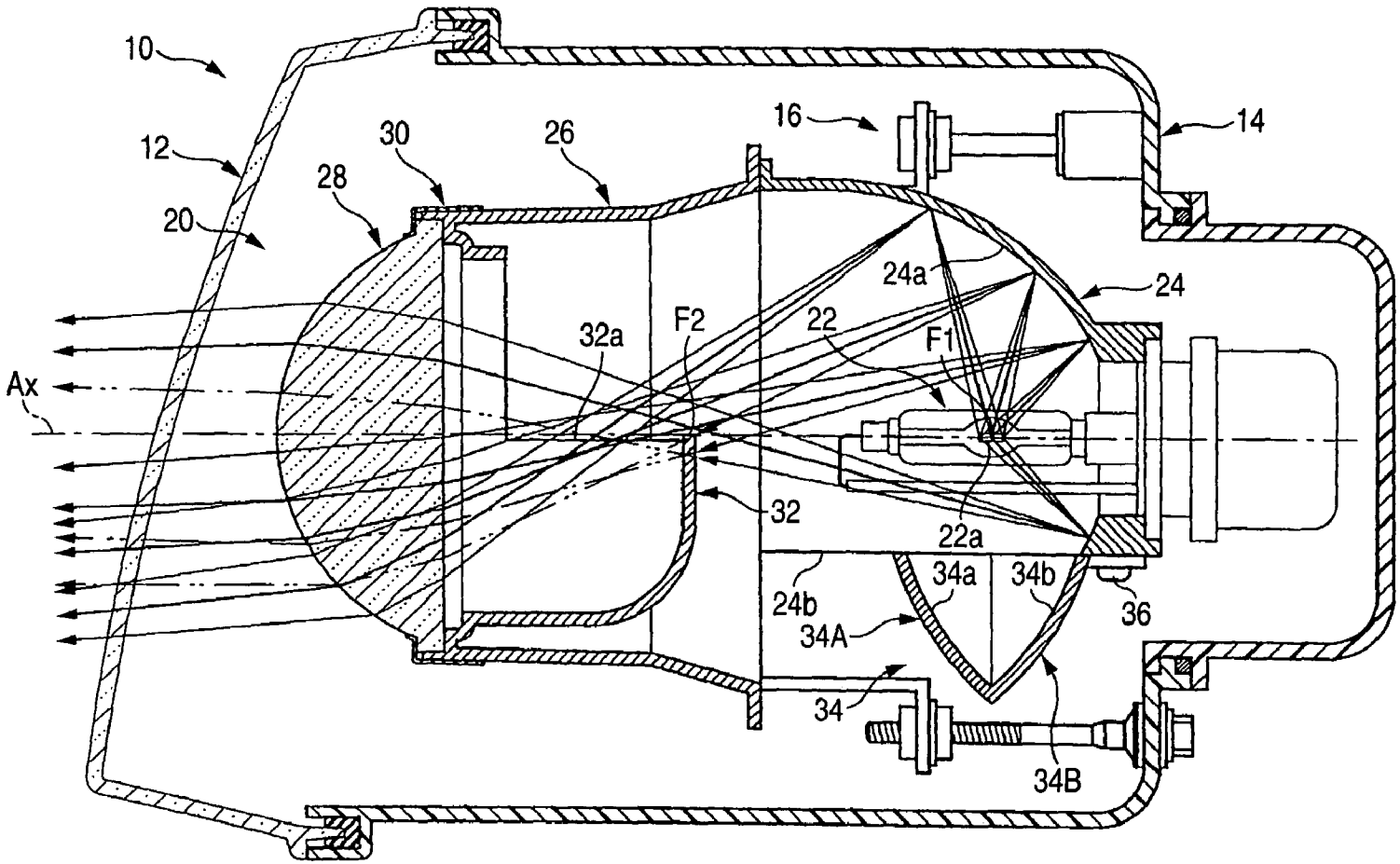
FIG. 1 is a sectional side view of a vehicle headlamp according to a first exemplary, non-limiting embodiment of the present invention.

FIG. 1 is a sectional side view of a vehicle headlamp according to a first exemplary, non-limiting embodiment of the present invention. A projector type lighting device unit 20, tiltable in vertical and lateral directions via an aiming mechanism 16, is contained within a lamp chamber formed with a plain transparent cover 12 and a lamp body 14 to construct a vehicle headlamp 10.

The lighting device unit 20 is a lighting device unit for emitting low beams of light, comprising a discharge bulb 22, a reflector 24, a holder 26, a projection lens 28, a retaining ring 30, a shade 32 and an additional reflector unit 34.

The discharge bulb 22 is a metal halide bulb with a light source 22*a* having a discharge light emitting portion fitted to the reflector 24, so that the light source is arranged coaxially with and on an optical axis Ax extending in the longitudinal direction of a vehicle. More specifically, the optical axis Ax extends downward approximately 0.5° to 0.6° with respect to the horizontal direction.

The reflector 24 has a reflective surface 24*a* in the form of a substantially elliptic spherical surface with the optical axis Ax as the central axis. The section of the reflective surface 24*a* including the optical axis Ax is set substantially elliptic in configuration with a first focal point F1 positioned at the center of the light source 22*a*, so that rays of light from the light source 22*a* are converged closer to the optical axis Ax before being reflected forward. The eccentricity of the reflective surface 24*a* increases from the orthogonal section toward the plane section.

A cutoff portion 24*b* is installed in the lower portion of the reflector 24, such that the reflector 24 is horizontally cut off to a position below the optical axis Ax by a predetermined dimension (e.g., approximately 15 mm).

The holder 26 extends forward in a cylindrical form from the front end of the opening of the reflector 24, and fixedly supports the reflector 24 in its rear end portion. Moreover, the holder 26 fixedly supports the projection lens 28 via the retaining ring 30 at its front end portion so that the projection lens 28 is disposed on the optical axis Ax.

The projection lens 28 is formed of a plano-convex lens having a convex surface on the front side and a flat surface on the rear side to project an image of the light source 22*a* as an inverted image, the image thereof being formed on a focal plane inclusive of a rearside focal point F2.

The shade 32 extends substantially along an orthogonal plane crossing the optical axis Ax with both of its lateral end portions extended forward in a roundabout way, and is installed integrally with the holder 26. The stepped upper end edges 32*a* of the shade 32 are disposed so as to pass through the rearside focal point F2 of the projection lens 28. Further, the shade 32 shields part of the light reflected from the reflective surface 24*a* of the reflector 24, to eliminate the upward light emitted forward through the projection lens 28. Thus, glare is substantially reduced The additional reflector unit 34 is provided under the light source 22*a* and fixedly supported by the cutoff portion 24*b* of the reflector 24 with screws 36. The additional reflector unit 34 is constructed with a pair of additional reflectors 34A and 34B disposed face to face longitudinally. The reflective surfaces 34*a* and 34*b* of the respective additional reflectors 34A and 34B are formed of paraboloids of revolution having the same focal distance with the first focal point F1 as their common focal point, and with the optical axis Ax as the central axis of the revolution.

Figure 2:
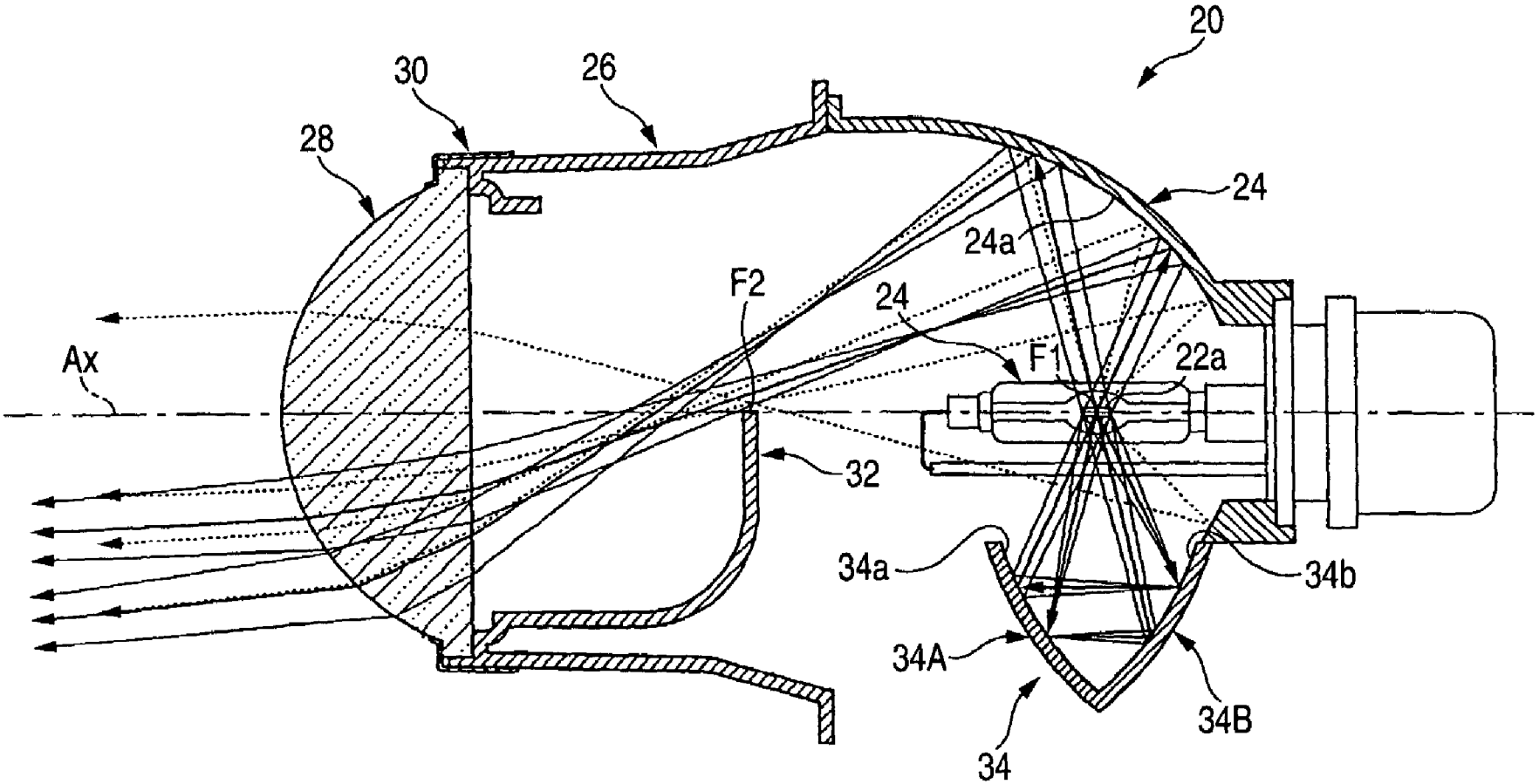
FIG. 2 is a sectional side view of a single article of a lighting device unit according to the first exemplary, non-limiting embodiment of the present invention.
Figure 3:
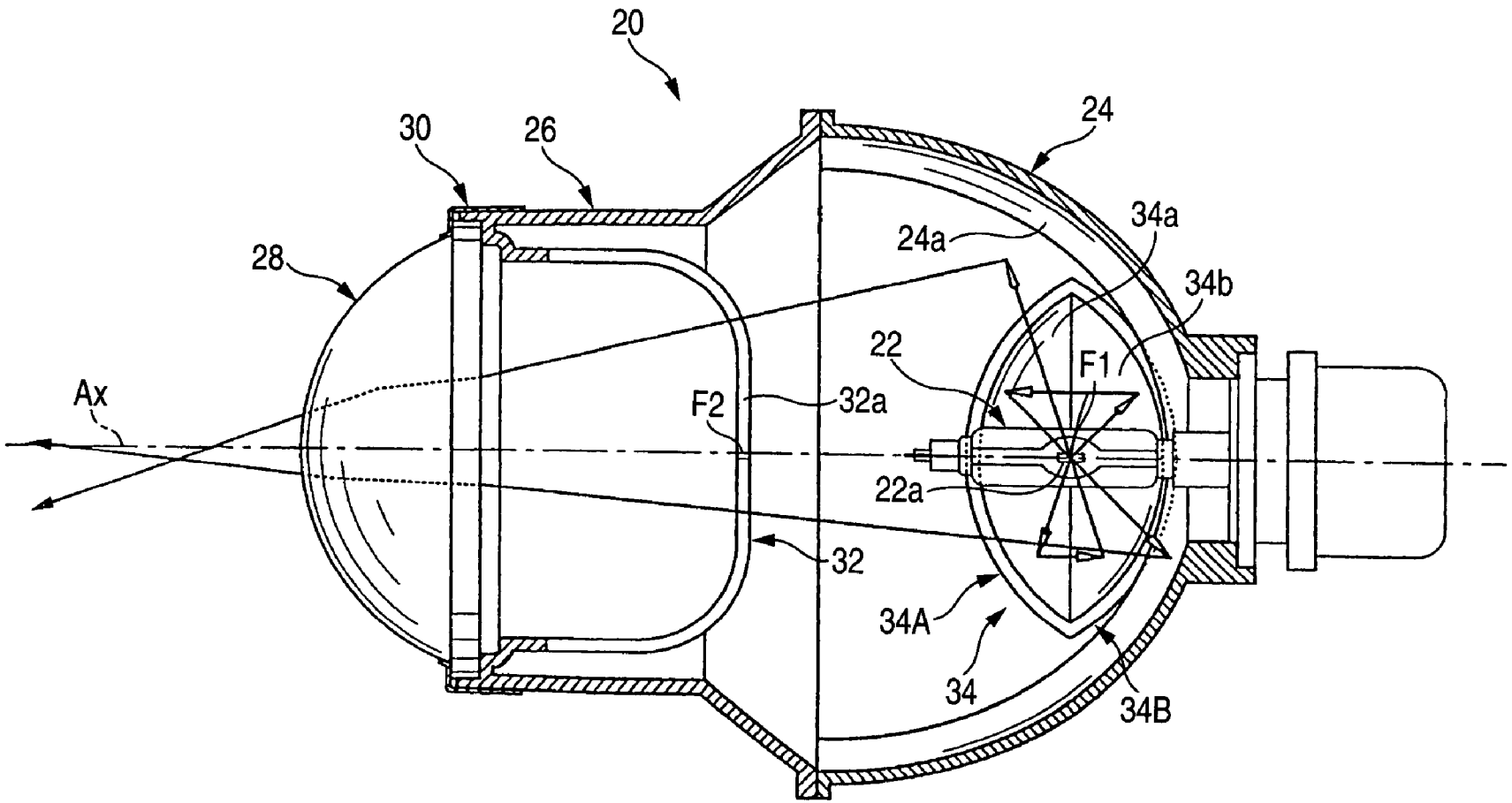
FIG. 3 is a sectional plan view of a single article of the lighting device unit according to the first exemplary, non-limiting embodiment of the present invention.
Figure 4:
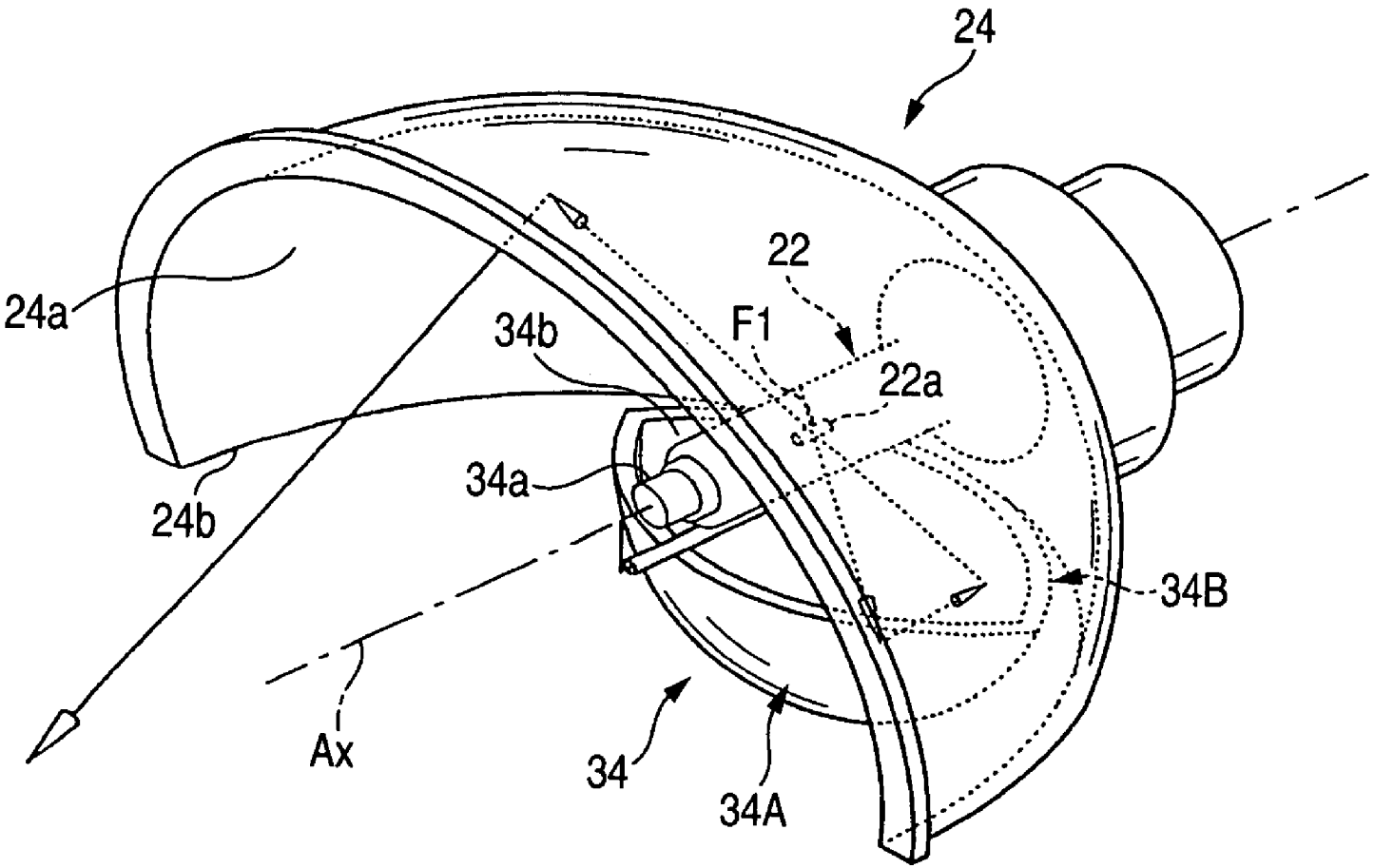
FIG. 4 is a perspective view of the principal part of the lighting device unit according to the first exemplary, non-limiting embodiment of the present invention.

FIG. 2 and FIG. 3 are a sectional side view and a sectional plan view of a single article of the lighting device unit 20, and FIG. 4 is a perspective view of the principal part of the lighting device unit 20.

As shown by these drawings, light from the light source 22*a* incident on the additional reflector 34A on the front side is reflected from the additional reflector 34A to be incident on the additional reflector 34B on the rear side. Then, the light is reflected from the additional reflector 34B and directed to the position of the light source 22*a* as retroreflective light to be incident on the upper reflective region of the reflector 24.

On the other hand, light from the light source 22*a* incident on the additional reflector 34B on the rear side is reflected from the additional reflector 34B to be incident on the additional reflector 34A on the front side. Then, the light is reflected from the additional reflector 34A and directed to the position of the light source 22*a* as retroreflective light to be incident on the upper reflective region of the reflector 24.

Each ray of retroreflective light incident on the upper reflective regions of the reflector 24 is reflected from the reflector 24 and emitted forward via the projection lens 28.

Figure 5:
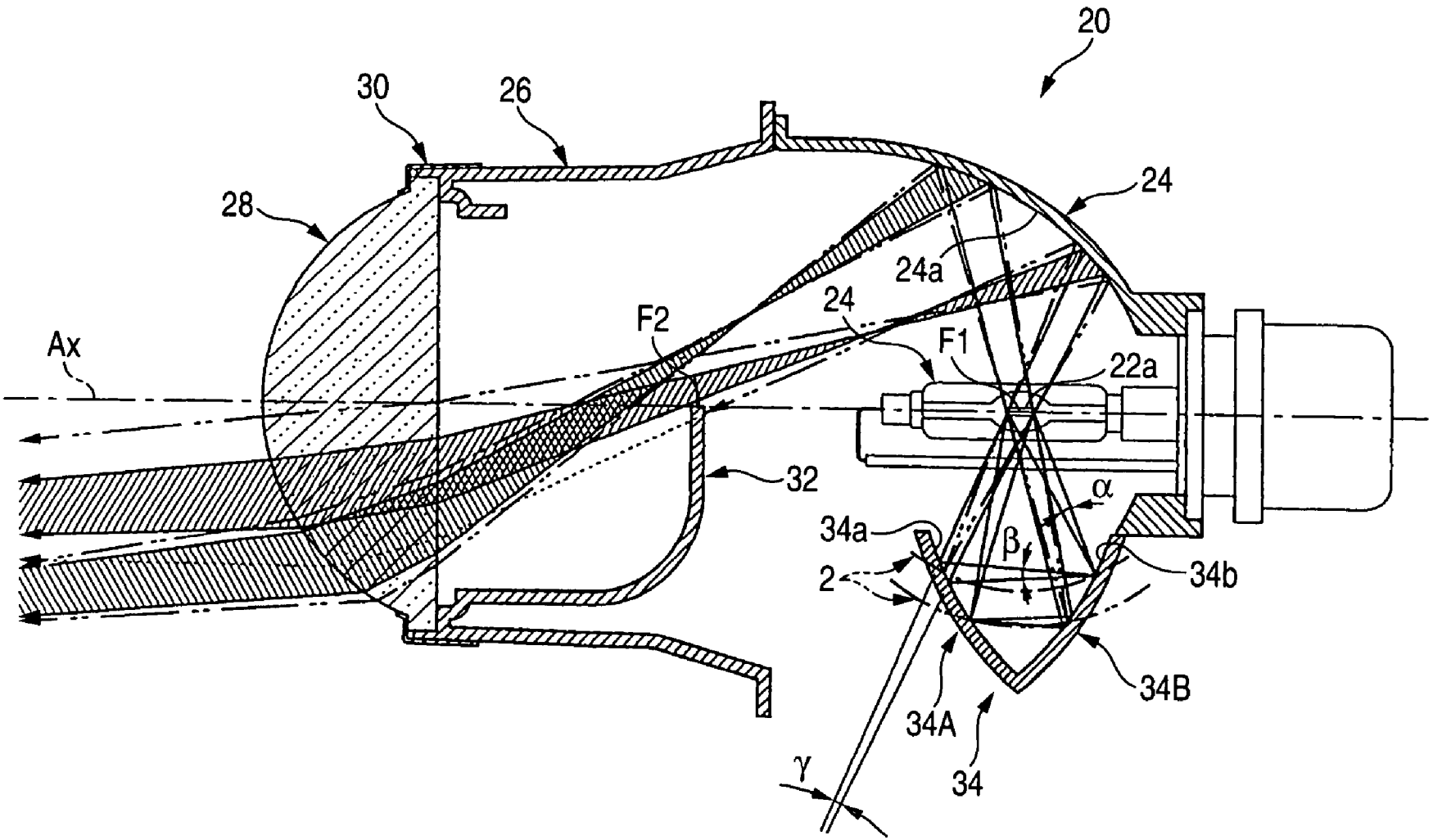
FIG. 5 is a diagram showing an optical path of retroreflective light from the additional reflector unit of the lighting device unit, in contrast to an optical path of retroreflective light from a spherical reflective surface centering on a light source, according to the first exemplary, non-limiting embodiment of the present invention.

FIG. 5 is a diagram showing an optical path of retroreflective light from the additional reflector unit 34 in contrast to an optical path of retroreflective light from a spherical reflective surface 2 centering on the light source 22*a* in a conventional art. In FIG. 5, the optical path of retroreflective light from the additional reflector unit 34 is shown by solid lines, whereas the optical path of retroreflective light from the related art spherical reflective surface 2 is shown by chain double-dashed lines.

Since the reflective surfaces 34*a* and 34*b* of the additional reflectors 34A and 34B are formed of paraboloids of revolution, spreading of retroreflective light from the additional reflector unit 34 is narrower than that of retroreflective light therefrom in the case of the related art spherical reflective surface 2. In other words, light from the light source 22*a* is incident on one point of the additional reflector 34B on the rear side, and incident again on the additional reflector 34A on the front side after being reflected from the point of incidence on the additional reflector 34B at the same spreading angle b as the estimated spreading angle a of light from the light source 22*a*.

However, the light reflected from the additional reflector 34A is directed to the position of the light source 22*a* at a spreading angle alpha narrower than the spreading angle beta of the light reflected from the additional reflector 34B. This is also the case with the incidence of light from the light source 22*a* on the additional reflector 34A on the front side.

On the other hand, light from the light source 22*a* incident on one point of the related art spherical reflective surface 2 is directed from the point of incidence on the related art spherical reflective surface 2 to the position of the light source 22*a* at substantially the same spreading angle as the estimated spreading angle of light from the light source 22*a*. Consequently, the spreading of retroreflective light from the additional reflector unit 34 becomes narrower than that of retroreflective light from the related art spherical reflective surface 2.

Thus, the image of the light source 22*a* formed by the retroreflective light reflected in the upper reflective region of the reflector 24 on the focal plane on the rear side of the projection lens 28 and emitted from the additional reflector unit 34 becomes smaller than the image formed by the retroreflective light from the related art spherical reflective surface 2. Moreover, variation in the image size because of a difference in the positions of incidence on the reflector 24 becomes smaller.

Figure 6:
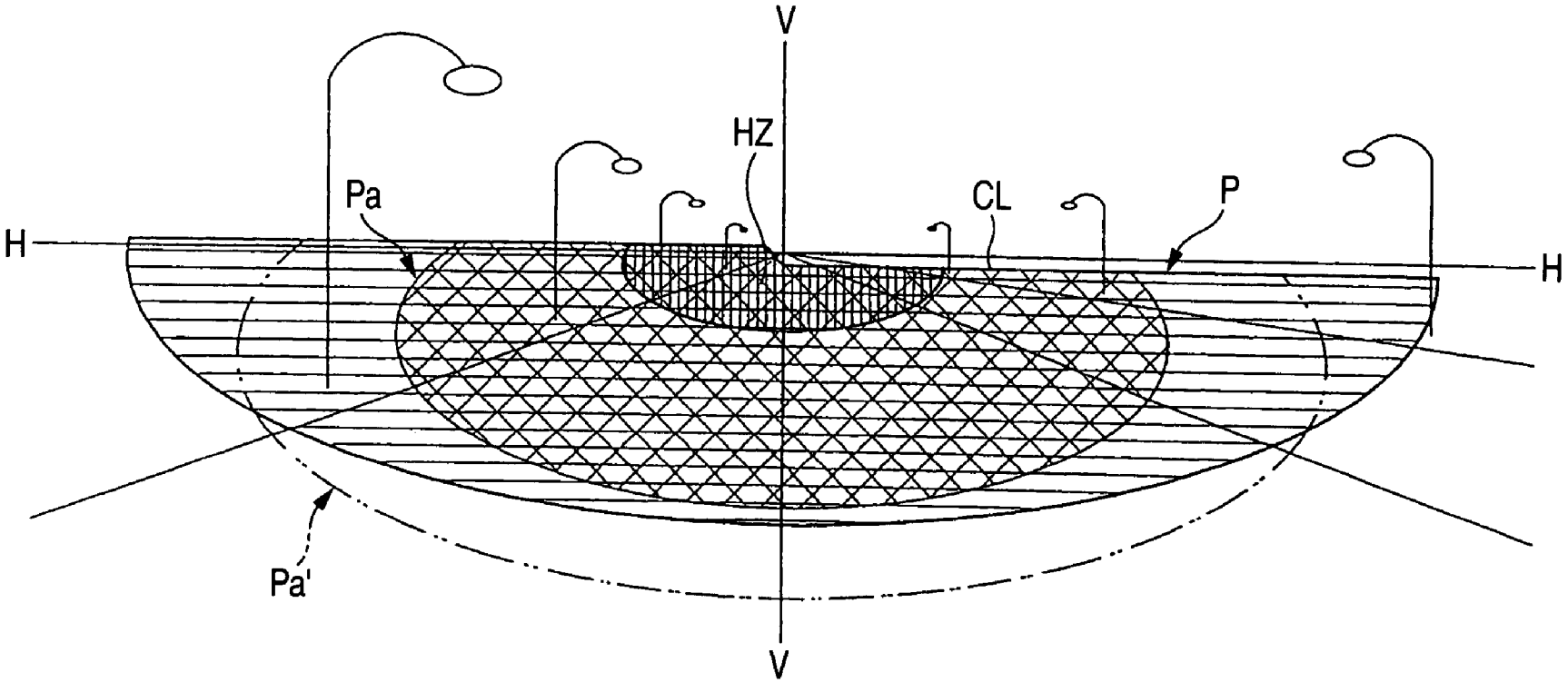
FIG. 6 is a perspective illustration of a low-beam luminous distribution pattern formed by the light emitted forward from the lighting device unit on an imaginary vertical screen disposed in a position 25 meters ahead of a lighting device, according to the first exemplary, non-limiting embodiment of the present invention.

FIG. 6 is a perspective illustration of a low-beam luminous distribution pattern formed by the light emitted forward from the lighting device unit 20 on an imaginary vertical screen disposed about 25 meters in front of the lighting device.

The low-beam luminous distribution pattern is a left-hand distributed luminous distribution pattern having a so-called Z-type cutoff line CL on laterally different levels. The pattern also has a hot zone Hz as a high luminous intensity area located at the upper-end of the central portion.

The low-beam luminous distribution pattern is produced by synthesizing a basic luminous distribution pattern P formed by direct light directly incident on the reflective surface 24*a* of the reflector 24 from the light source 22*a*, with an additional luminous distribution pattern Pa formed by retroreflective light incident on the reflective surface 24*a* of the reflector 24 from the light source 22*a* via the additional reflector unit 34.

The additional luminous distribution pattern Pa strengthens the brightness of the basic luminous distribution pattern P, so that the brightness of the middle diffusion area of the basic luminous distribution pattern P is strengthened from a short to long distance area of the road surface ahead of a vehicle, according to this exemplary, non-limiting embodiment of the present invention.

A luminous distribution pattern Pa' shown by a chain double-dashed line in FIG. 6 is an additional luminous distribution pattern formed by retroreflective light from the reflective surface 24*a* when the related art spherical reflective surface 2 shown by the chain double-dashed line in FIG. 5 is arranged instead of the additional reflector unit 34.

As described above, the image of the light source 22*a* formed by the retroreflective light from the additional reflector unit 34 on the focal plane on the rear side of the projection lens 28 is smaller than the image formed by the retroreflective light from the related art spherical reflective surface 2. Accordingly, variation in the image size because of a difference in the positions of incidence on the reflector 24 is decreased. Consequently, the additional luminous distribution pattern Pa formed as an inverted image is substantially smaller in spreading than the additional luminous distribution pattern Pa', and thus the luminous intensity distribution becomes uniform.

Figure 7A:
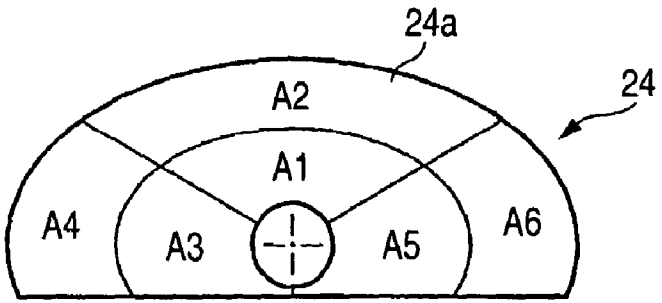
FIG. 7A and FIG. 7B are diagrams showing the relation between the reflective surface of a reflector and a basic luminous distribution pattern formed by the light reflected from the reflective surface according to the first exemplary, non-limiting embodiment of the present invention.
Figure 7B:
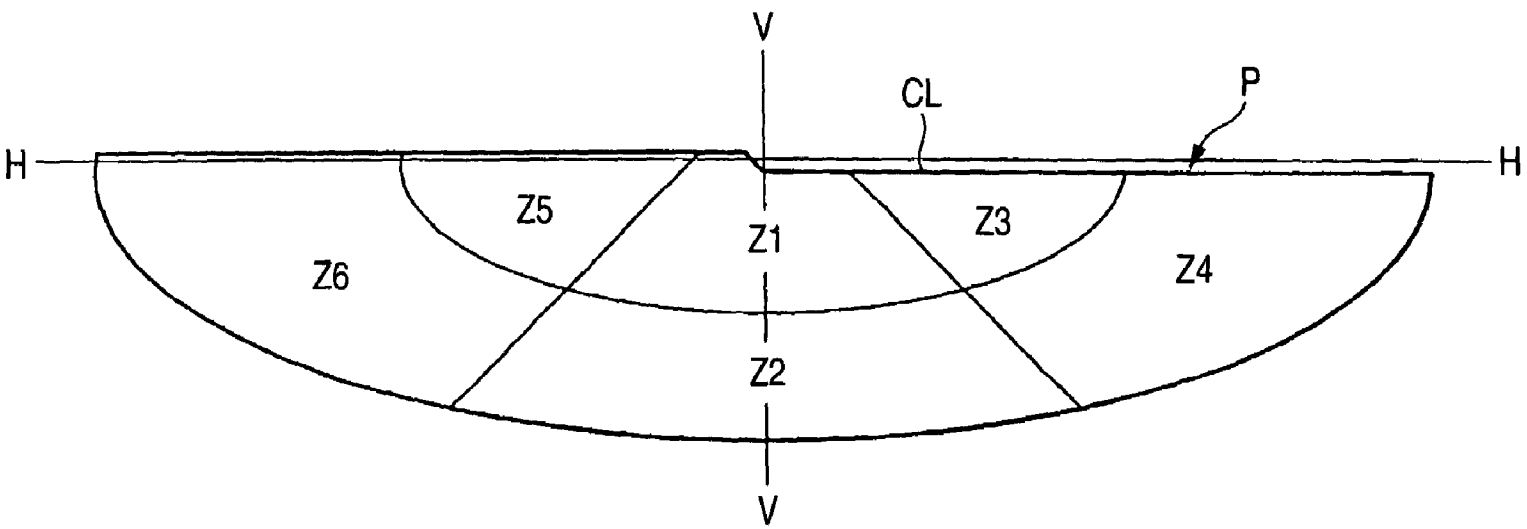

FIG. 7A and FIG. 7B are diagrams showing the relation between the reflective surface 24*a* of the reflector 24 and the basic luminous distribution pattern P formed by the light reflected from the reflective surface 24*a*, respectively.

FIG. 7A is a diagram seen from the rear side of the reflective surface 24*a*. The reflective surface 24*a* of the reflector 24 is divided into six reflective regions A1–A6.

FIG. 7B is a diagram showing the basic luminous distribution pattern P formed on the imaginary vertical screen disposed in a position 25 meters ahead of the lighting device by the light reflected forward from the reflective surface 24*a* of the reflector 24 with the basic luminous distribution pattern P roughly divided into six luminous distribution patterns Z1–Z6 formed by the light reflected from the six reflective regions A1–A6, respectively.

As shown in FIG. 7A and FIG. 7B, the reflective regions A1–A6 and the luminous distribution patterns A1–Z6 are laterally reversed. Moreover, the luminous distribution patterns Z1, Z3 and Z5 corresponding to the reflective regions A1, A3 and A5 positioned on the inner peripheral side of the reflective surface 24*a* are formed closer to the center of the basic luminous distribution pattern P. The luminous distribution patterns Z2, Z4 and Z6 corresponding to the reflective regions A2, A4 and A6 positioned on the outer peripheral side of the reflective surface 24*a* are formed closer to the outer peripheral edge of the basic luminous distribution pattern P.

As the retroreflective light from the additional reflector unit 34 is incident on the reflector 24 so as to be directed to the position of the light source 22*a* from each of the additional reflectors 34A and 34B, the relation between the reflective region and the additional luminous distribution pattern Pa is substantially the same as in the case of the basic luminous distribution pattern P.

As described in detail above, it has been arranged that the vehicle headlamp 10 according to this exemplary, non-limiting embodiment of the invention emits low beams of light, using the projector type lighting device unit 20 having the shade 32. However, the retroreflective light from the additional reflector 34 can also be utilized, as the additional reflector unit 34 with the pair of additional reflectors 34A and 34B disposed face to face is provided under the light source 22*a*. Thus, efficiency in utilizing the luminous flux of the light source can be increased to the extent of the presence of retroreflective light.

At this time, since the reflective surfaces 34*a* and 34*b* of the additional reflectors 34A and 34B constituting the additional reflector unit 34 are formed of paraboloids of revolution with the first focal point F1 of the reflective surface 24*a* of the reflector 24 as their common focal point and with the optical axis Ax as the central axis of the revolution, the spreading of retroreflective light from the additional reflector unit 34 is narrower than that of retroreflective light from the spherical reflective surface 2. Thus, the additional luminous distribution pattern. Pa formed by the retroreflective light reflected in the upper reflective region of the reflector 24 is substantially smaller in spreading compared with the additional luminous distribution pattern Pa' formed with the related art spherical reflective surface 2 and the luminous intensity distribution becomes uniform.

Therefore, according to this exemplary, non-limiting embodiment of the present invention, luminous distribution control utilizing the retroreflective light becomes readily performable.

According to this exemplary, non-limiting embodiment of the present invention in particular, since the pair of additional reflectors 34A and 34B constituting the additional reflector unit 34 are disposed face to face with respect to the longitudinal direction, it is possible to precisely set a position where the retroreflective light is incident on the upper reflective region of the reflector 24 longitudinally. Accordingly, control of the longitudinal spreading of the additional luminous distribution pattern Pa formed by the retroreflective light reflected from the reflector 24 can be performed with precision.

Second Embodiment

Figure 8:
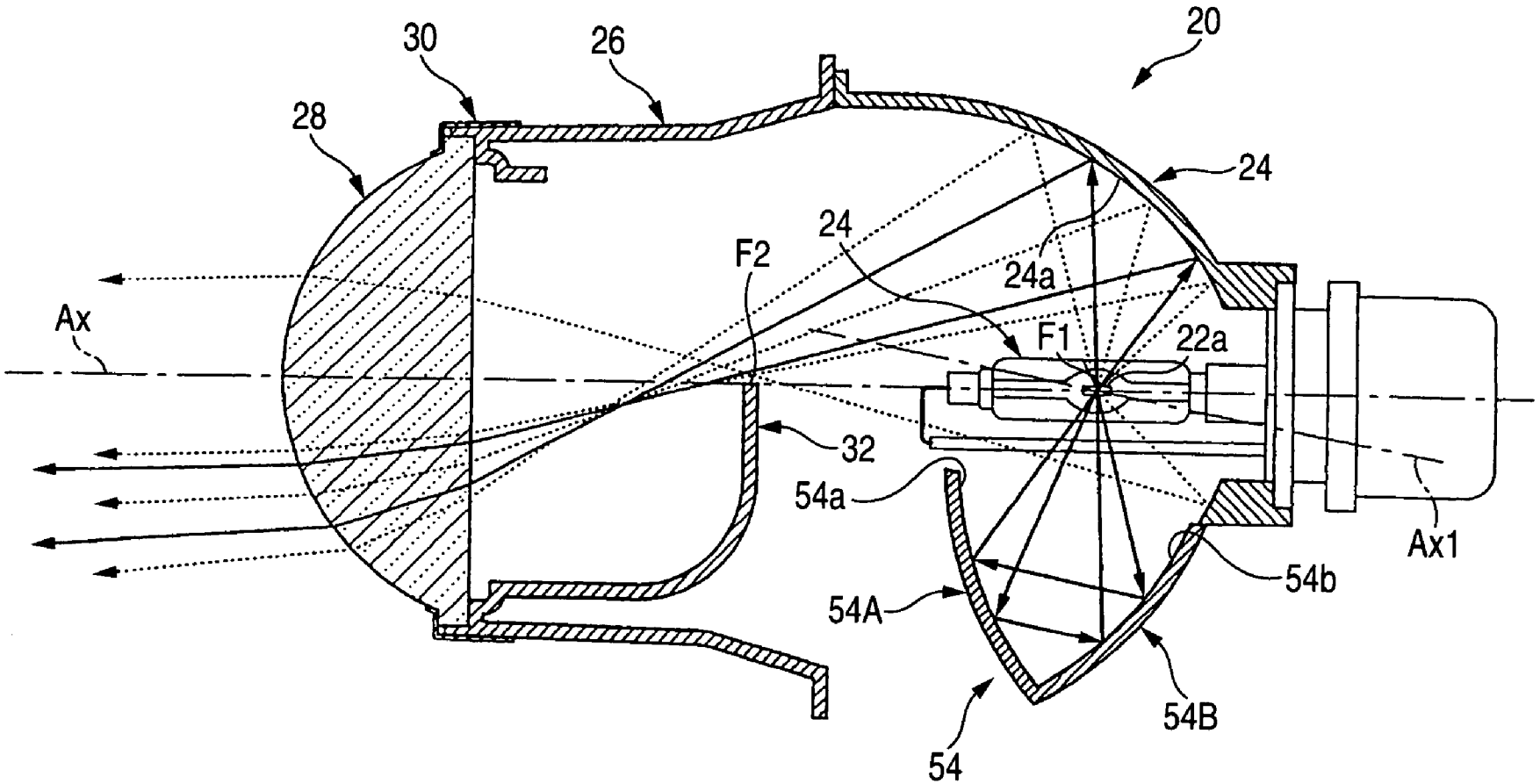
FIG. 8 is a diagram showing an additional reflector unit according to a second exemplary, non-limiting embodiment of the present invention.

FIG. 8 is a sectional side view of an additional reflector unit 54 of a second exemplary, non-limiting embodiment, which sectional side view is substantially similar to FIG. 2. Description of the same reference characters as already described above are not repeated below.

As shown in FIG. 8, the additional reflector unit 54 of the second exemplary, non-limiting embodiment is similar to the additional-reflector unit 34 according to the first embodiment of the invention. For example, but not by way of limitation, a pair of additional reflectors 54A and 54B constituting the additional reflector unit 54 are disposed face to face with respect to the longitudinal direction, and the reflective surfaces 54*a* and 54*b* of the additional reflectors 54A and 54B are formed of paraboloids of revolution with the first focal point F1 of the reflective surface 24*a* of the reflector 24 as their common focal point.

In the second embodiment, however, the central axis Ax1 of the paraboloids of revolution forming the reflective surfaces 54*a* and 54*b* is set upward by a predetermined angle with respect to the optical axis Ax.

Thus, a position where retroreflective light from the additional reflector unit 54 is incident on the upper reflective region of the reflector 24 is displaced closer to the rear end portion of the reflective surface 24*a* in this exemplary, non-limiting embodiment (second embodiment) as compared with the first exemplary, non-limiting embodiment.

Figure 9:
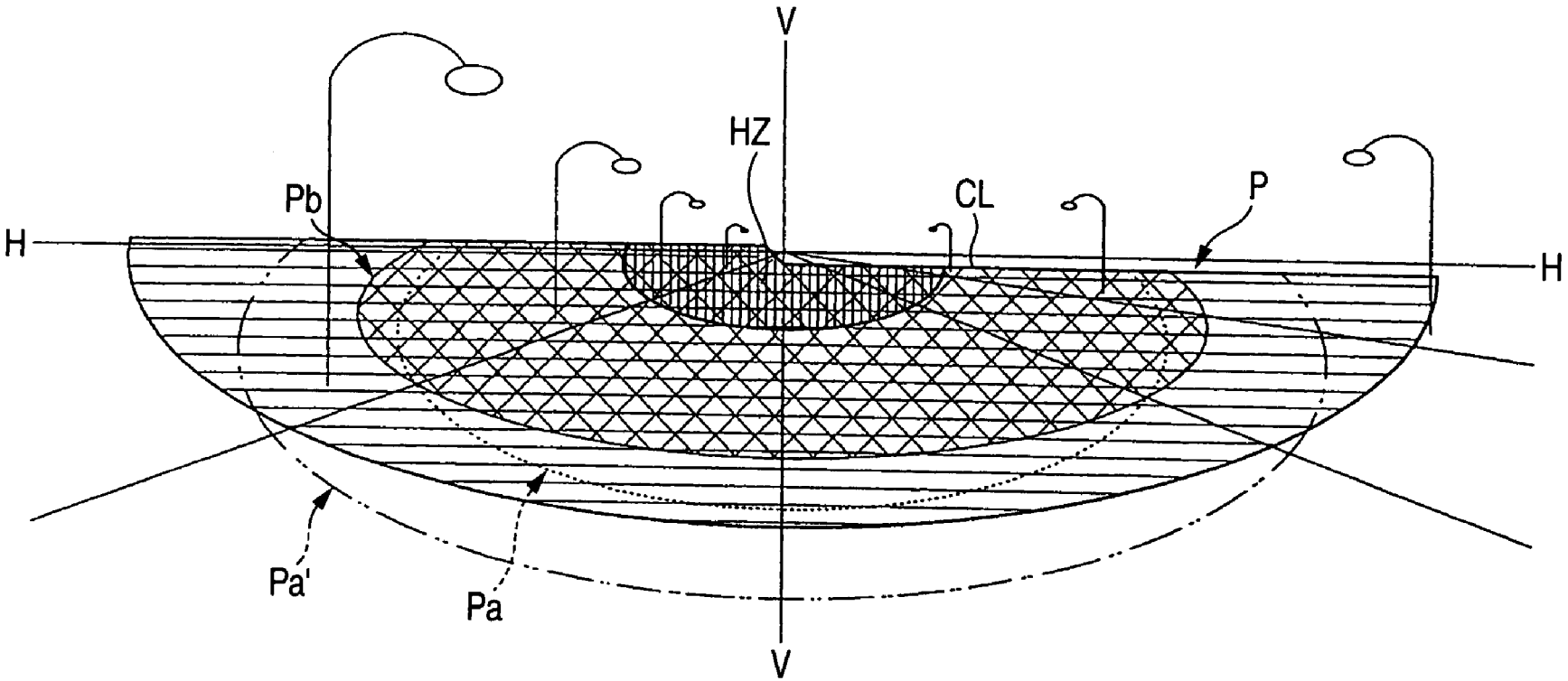
FIG. 9 is a diagram showing an additional luminous distribution pattern formed by retroreflective light from the additional reflector unit together with the basic luminous distribution pattern in the second exemplary, non-limiting embodiment of the present invention.

FIG. 9 is a perspective illustration of an additional luminous distribution pattern Pb formed by retroreflective light incident on the reflector 24 from the light source 22*a* via the additional reflector unit 54 together with the basic luminous distribution pattern P, the perspective illustration thereof being similar to what is shown in FIG. 6.

As shown in FIG. 9, the additional luminous distribution pattern Pb according to the second embodiment is a flat luminous distribution pattern compressed closer to the cutoff line CL, as compared with the additional luminous distribution pattern Pa according to the first exemplary, non-limiting embodiment. By forming the additional luminous distribution pattern Pb in this manner, the brightness of the middle diffusion area of the basic luminous distribution pattern P can be strengthened from a middle to long distance area of the road surface ahead of a vehicle.

Third Embodiment

Figure 10:
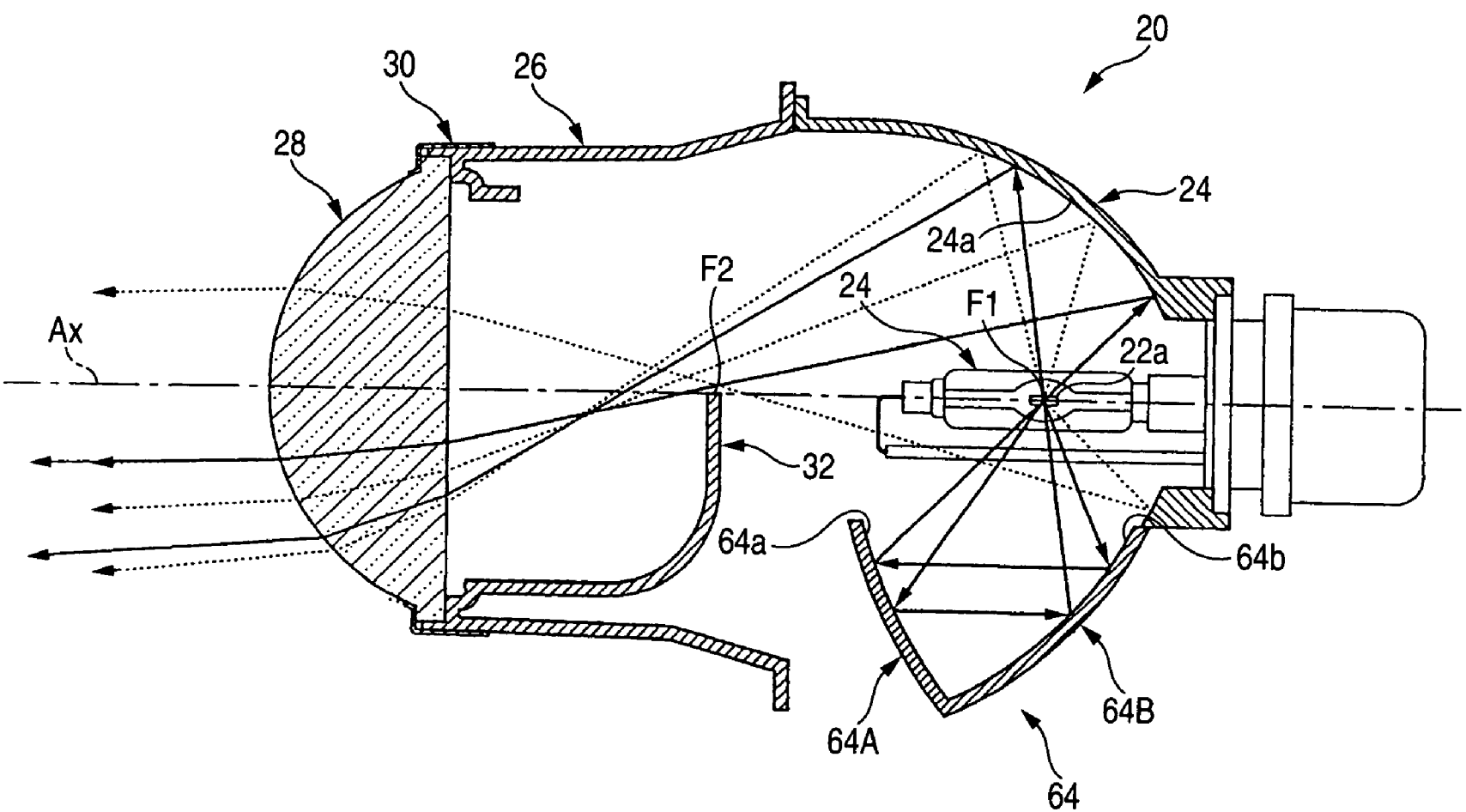
FIG. 10 is a diagram showing an additional reflector unit according to a third exemplary, non-limiting embodiment of the present invention.

FIG. 10 is a sectional side view of an additional reflector unit 64 in a third exemplary, non-limiting embodiment, which sectional side view is similar to what is shown in FIG. 2. Description of the same reference characters as already described above are not repeated below.

As shown in FIG. 10, the additional reflector unit 64 in this exemplary, non-limiting embodiment (third embodiment) is similar to the additional reflector unit 34 according to the first embodiment, in that a pair of additional reflectors 64A and 64B constituting the additional reflector unit 64 are disposed face to face with respect to the longitudinal direction, and that the reflective surfaces 64*a* and 64*b* of the additional reflectors 64A and 64B are formed of paraboloids of revolution with the first focal point F1 of the reflective surface 24*a* of the reflector 24 as their common focal point and with the optical axis Ax as the central axis of the revolution.

In the third exemplary, non-limiting embodiment, however, the focal distances of the paraboloids of revolution constituting the reflective surfaces 64*a* and 64*b* differ from each other. For example, but not by way of limitation, the focal distance of the paraboloid of revolution forming the reflective surface 64*a* is set at a value greater than that of the focal distance of the paraboloid of revolution forming the reflective surface 64*b*. In the third embodiment, the reflective surfaces 64*b* extend forward slightly longer than the second embodiment.

Thus, in this third exemplary, non-limiting embodiment, luminous flux incident on the additional reflector unit 64 from the light source 22*a* is increased. Furthermore, a position where retroreflective light from the additional reflector unit 64 is incident on the upper reflective region of the reflector 24 is displaced closer to the rear end portion of the reflective surface 24*a*, compared with the embodiment as described above.

Figure 11:
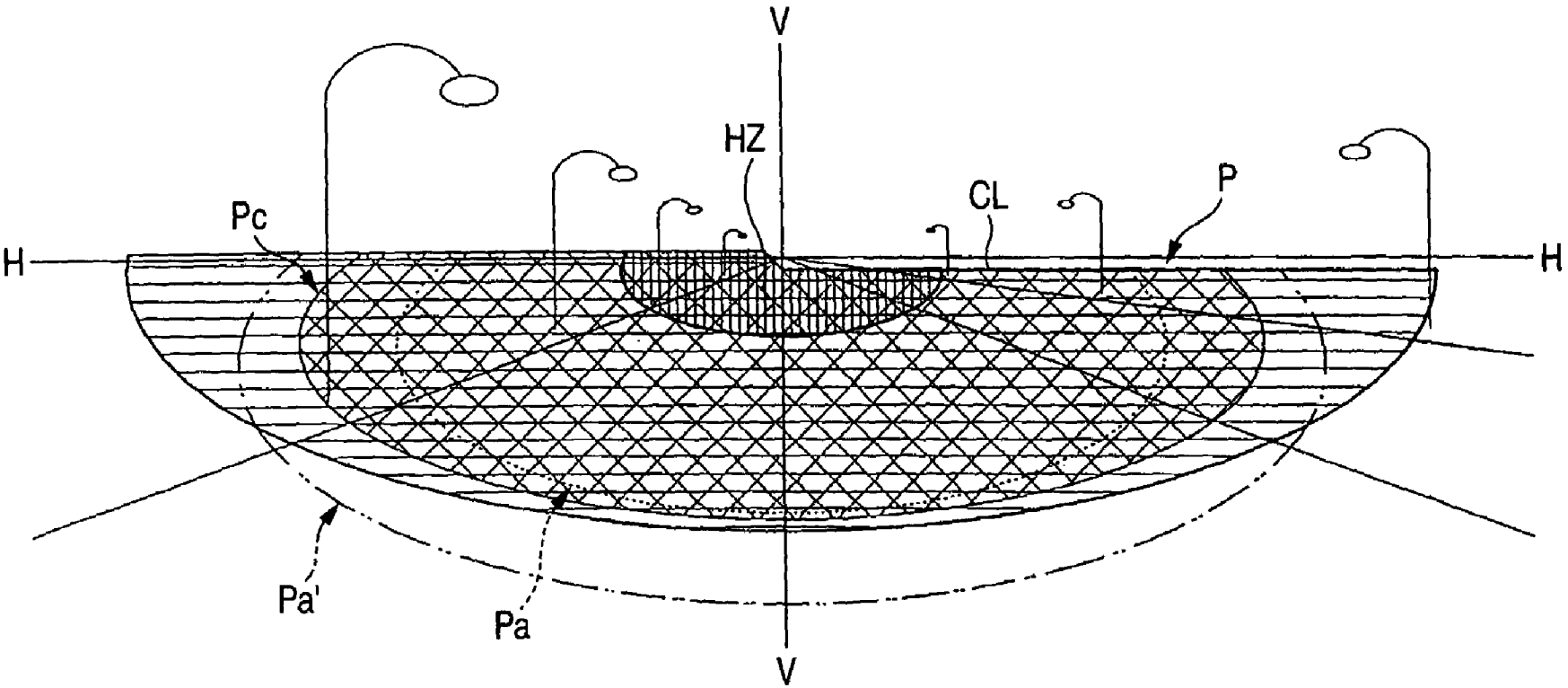
FIG. 11 is a diagram an additional luminous distribution pattern formed by retroreflective light from the additional reflector unit together with the basic luminous distribution pattern in the third exemplary, non-limiting embodiment of the present invention.

FIG. 11 is a perspective illustration of an additional luminous distribution pattern Pc formed by retroreflective light incident on the reflector 24 from the light source 22*a* via the additional reflector unit 64 together with the basic luminous distribution pattern P, the perspective illustration thereof being similar to what is shown in FIG. 6.

As shown in FIG. 11, the additional luminous distribution pattern Pc is, a bright luminous distribution pattern slightly spread in the lateral direction as compared with the additional luminous distribution pattern Pa according to the first exemplary, non-limiting embodiment. By forming the additional luminous distribution pattern Pc like this, the brightness of the middle diffusion area of the basic luminous distribution pattern P can be strengthened over a slightly wider lateral range from a short to long distance area of the road surface ahead of a vehicle.

Fourth Embodiment

Figure 12:
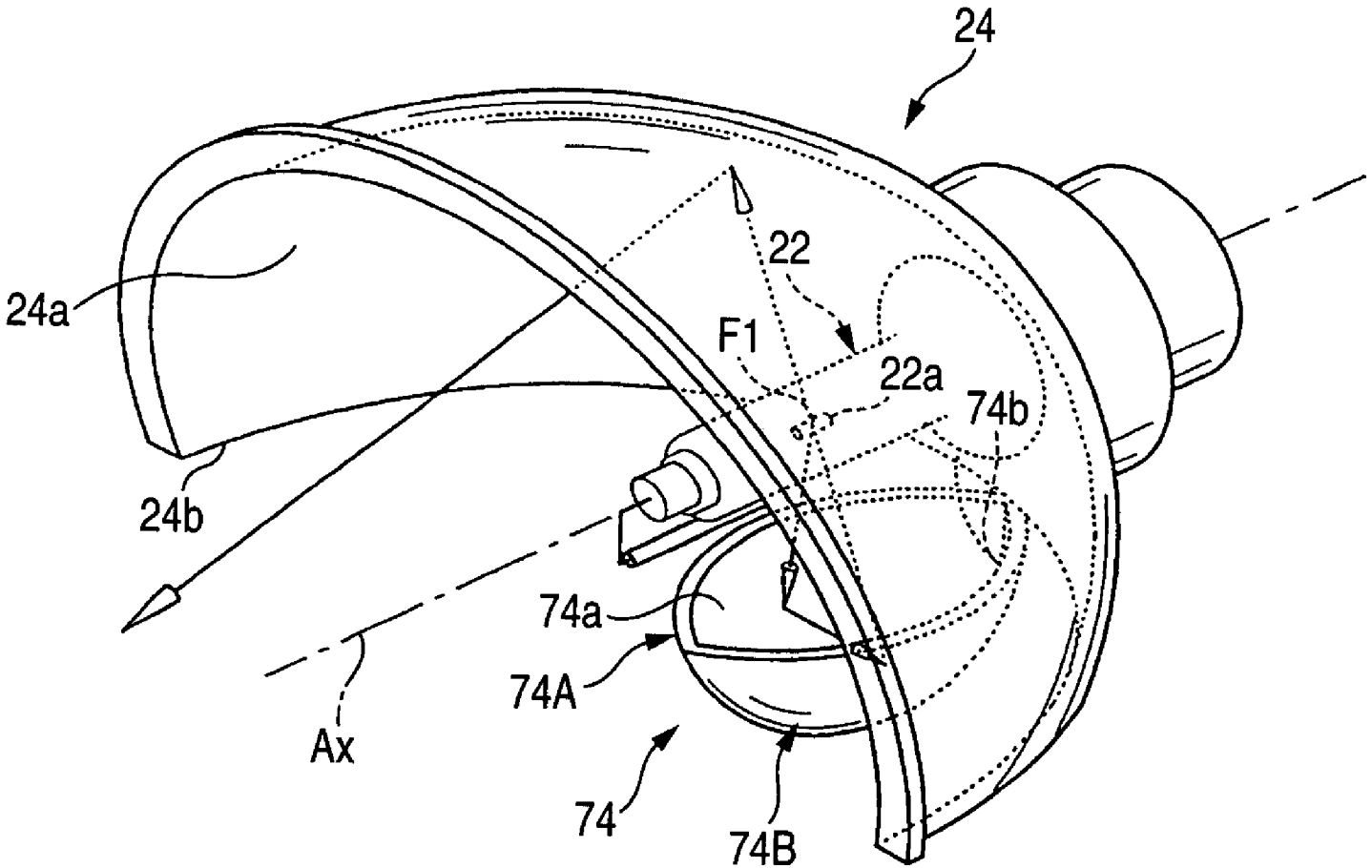
FIG. 12 is a diagram showing an additional reflector unit according to a fourth exemplary, non-limiting embodiment of the present invention.

FIG. 12 is a perspective view of an additional reflector unit 74 according to a fourth exemplary, non-limiting embodiment, which perspective view is similar to what is shown in FIG. 4. For the sake of simplicity, the description of substantially similar reference characters already shown above is not repeated.

As shown in FIG. 12, a pair of additional reflectors 74A and 74B constituting the additional reflector unit 74 according to this embodiment (fourth embodiment) are disposed face to face not with respect to the longitudinal direction according to the first embodiment but with respect to the lateral direction. The additional reflector unit 74 in this embodiment is similar to the additional reflector unit 34 according to the first embodiment in that the reflective surfaces 74*a* and 74*b* of the additional reflectors 74A and 74B are formed of paraboloids of revolution with the first focal point F1 of the reflective surface 24*a* of the reflector 24 as their common focal point.

Thus, in this modified example, a position where retroreflective light from the additional reflector unit 74 is incident on the upper reflective region of the reflector 24 is displaced closer to the center of the reflective surface 24*a* in the lateral direction as compared with the above embodiment of the invention.

Figure 13:
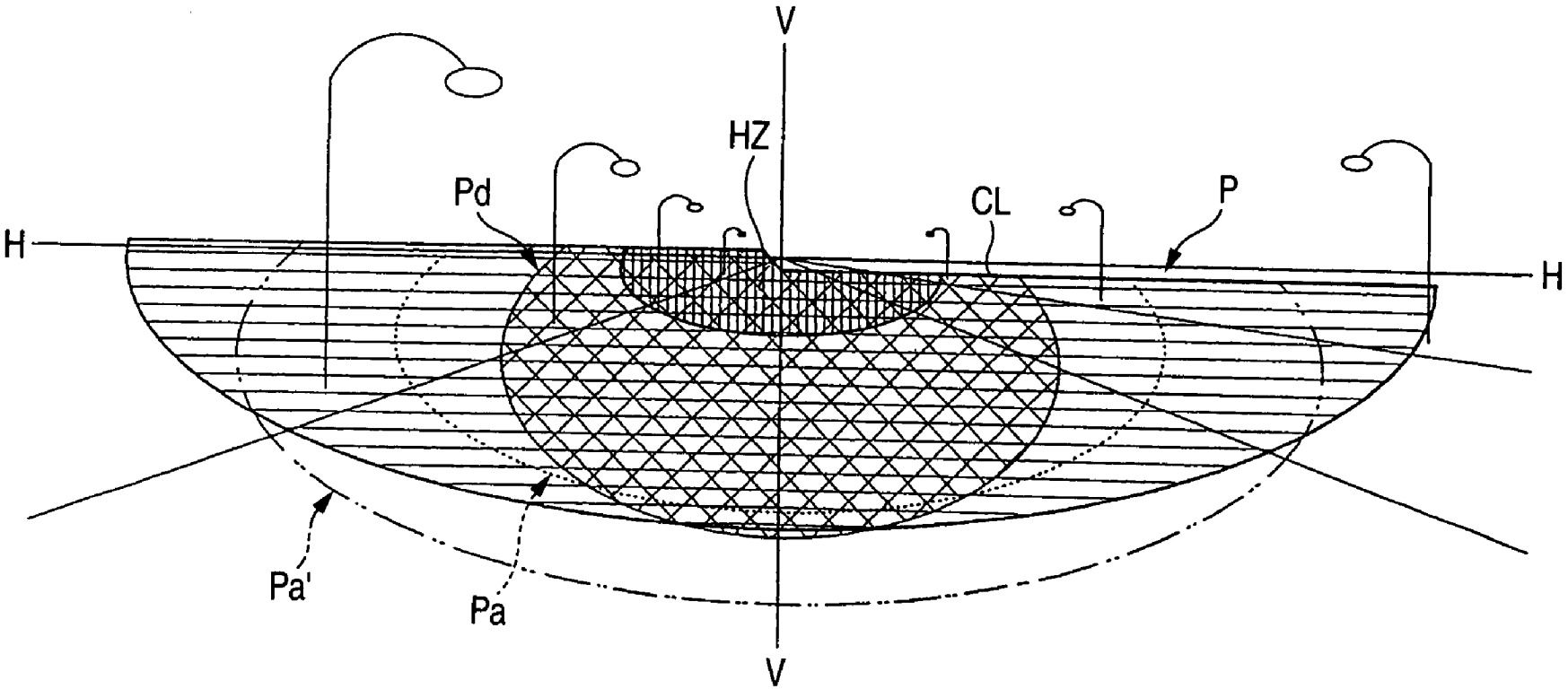
FIG. 13 is a diagram showing an additional luminous distribution pattern formed by retroreflective light from the additional reflector unit together with the basic luminous distribution pattern in the fourth exemplary, non-limiting embodiment of the present invention.

FIG. 13 is a perspective illustration of an additional luminous distribution pattern Pd formed by retroreflective light incident on the reflective surface 24*a* of the reflector 24 from the light source 22*a* via the additional reflector unit 74 together with the basic luminous distribution pattern P, the perspective illustration thereof being similar to what is shown in FIG. 6.

As shown in FIG. 13, the additional luminous distribution pattern Pd is a luminous distribution pattern having a small lateral diffusion angle. By forming the additional luminous distribution pattern Pd in this manner, the brightness of the small diffusion area of the basic luminous distribution pattern P can be strengthened from a short to long distance area of the road surface ahead of a vehicle.

Fifth Embodiment

Figure 14:
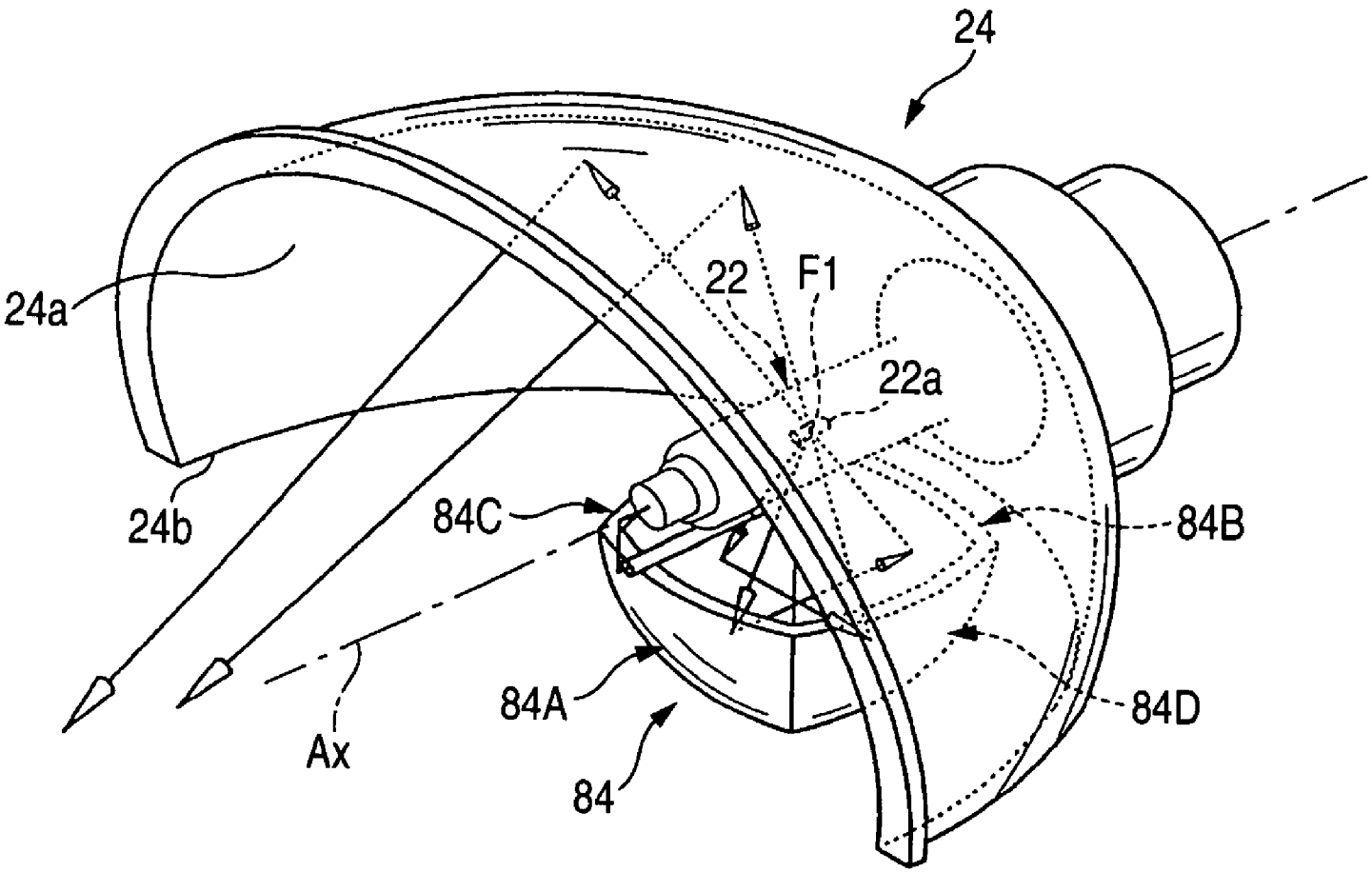
FIG. 14 is diagram showing an additional reflector unit according to a fifth exemplary, non-limiting embodiment of the present invention.

FIG. 14 is a perspective view of an additional reflector unit 84 according to a fifth exemplary, non-limiting embodiment, which perspective view is similar to what is shown in FIG. 4. For the sake of simplicity, redundant description of substantially similar features is omitted.

As shown in FIG. 14, the additional reflector unit 84 is constructed with a pair of additional reflectors 84A and 84B disposed face to face with respect to the longitudinal direction, and with a pair of additional reflectors 84C and 84D disposed face to face with respect to the lateral direction. The additional reflector unit 84 in this exemplary, non-limiting embodiment (fifth embodiment) is similar to the additional reflector unit 34 according to the first embodiment of the invention in that the reflective surfaces of the additional reflectors 84A, 84B, 84C and 84D are formed of paraboloids of revolution with the first focal point F1 of the reflective surface 24*a* of the reflector 24 as their common focal point.

In this exemplary, non-limiting embodiment, two sets of the pairs of additional reflectors are disposed substantially orthogonally, so that a longitudinal position where retroreflective light from the additional reflector unit 84 is incident on the upper reflective region of the reflector 24 is maintained in substantially the same way as the first embodiment, whereas a lateral position as to the foregoing is displaced closer to the center of the reflective surface 24*a* as compared with the first embodiment.

Figure 15:
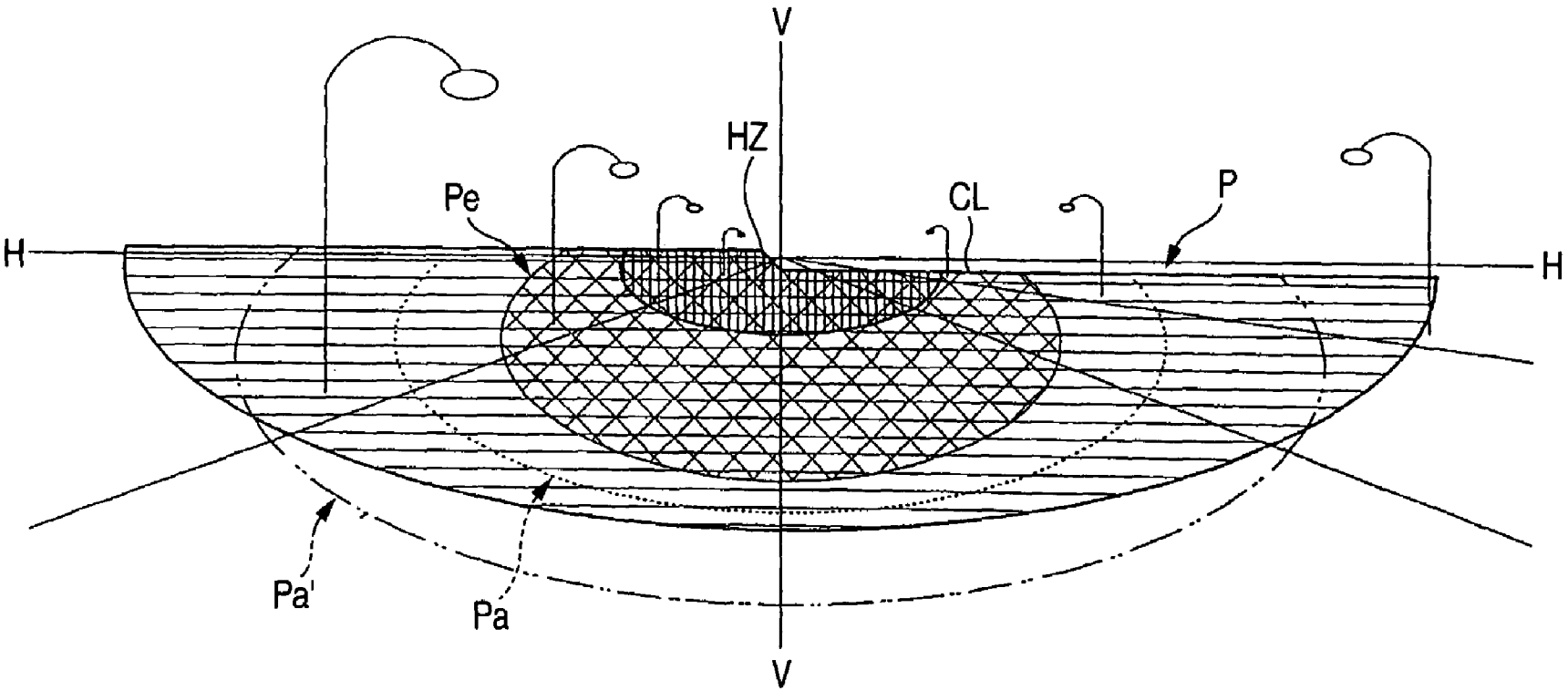
FIG. 15 is a diagram showing an additional luminous distribution pattern formed by retroreflective light from the additional reflector unit together with the basic luminous distribution pattern in the fifth exemplary, non-limiting embodiment of the present invention.

FIG. 15 is a perspective illustration of an additional luminous distribution pattern Pe formed by retroreflective light incident on the reflector 24 from the light source 22*a* via the additional reflector unit 84 together with the basic luminous distribution pattern P, the perspective illustration thereof being similar to what is shown in FIG. 6.

As shown in FIG. 15, the additional luminous distribution pattern Pe is a bright luminous distribution pattern that is one size smaller compared to the additional luminous distribution pattern Pa according to the first embodiment. By forming the additional luminous distribution pattern Pe in this manner, the brightness of the peripheral area of the hot zone HZ of the basic luminous distribution pattern P can be strengthened.

Sixth Embodiment

Figure 16:
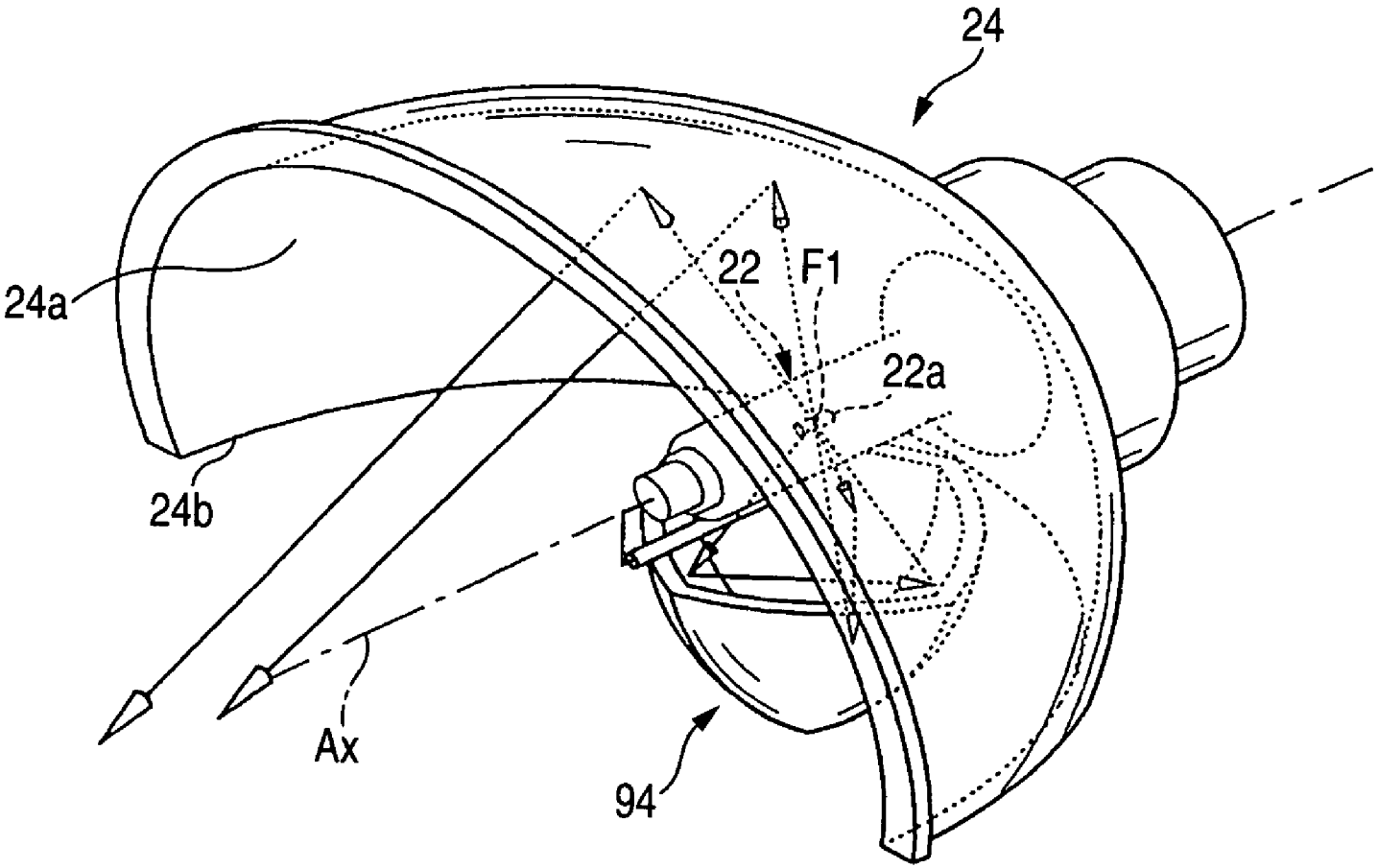
FIG. 16 is a diagram showing an additional reflector unit according to a sixth exemplary, non-limiting embodiment of the present invention.

FIG. 16 is a perspective view of an additional reflector unit 94 according to a sixth exemplary, non-limiting embodiment, which perspective view is similar to what is shown in FIG. 4.

As shown in FIG. 16, the additional reflector unit 94 in this embodiment (sixth embodiment) is constructed by turning the additional reflector unit 84 in the fifth embodiment around a vertical axis passing through the first focal point F1 of the reflective surface 24*a* of the reflector 24, by about 45°.

Even when the arrangement in this embodiment (sixth embodiment) is adopted, substantially same operation working effect as that of the fifth embodiment is achievable.

In the aforementioned embodiments of the present invention, the positions of focal points of the reflective surfaces constituting the respective additional reflectors 34, 54, 64, 74, 84 and 94 are set to the first focal point F1 of the reflective surface 24*a* of the reflector 24, so that the retroreflective light from the additional reflectors 34, 54, 64, 74, 84 and 94 are accurately returned to the position of the light source 22*a*.

However, it is practicable that by setting the positions of focal points of the reflective surfaces constituting the additional reflectors 34, 54, 64, 74, 84 and 94 to a position slightly deviating from the first focal point F1 instead, retroreflective light from the additional reflectors 34, 54, 64, 74, 84 and 94 is returned to a position slightly deviating from the position of the light source 22*a*.

In the aforementioned embodiments of the present invention, one or two pairs of additional reflector units have been described as integrally constructed. However, it is also possible to form the additional reflectors as members independent of each other.

The present invention is not limited to the specific above-described embodiments. It is contemplated that numerous modifications may be made to the present invention without departing from the spirit and scope of the invention as defined in the following claims.

What is claimed is:

1. A vehicle headlamp having a lighting device unit for emitting low beams of light, said lighting device unit comprising:

a light source, for emitting rays of light, disposed on an optical axis extending in a longitudinal direction with respect to a vehicle;

a reflector that reflects a first part of the rays of light forward;

a projection lens positioned in front of the reflector;

a shade disposed between the projection lens and the reflector, that shields a part of the light reflected from the reflector; and a pair of opposed additional reflectors disposed face to face with respect to each other, thereby providing double reflection of a second part of the rays of light and redirection thereof toward the reflector, said pair of opposed additional reflectors positioned under the light source.

2. The vehicle headlamp according to claim 1, wherein the reflective surfaces of the pair of respective additional reflectors are formed in a configuration comprising paraboloids of revolution, the position of the light source is substantially a focal point, and a common axis extends in a predetermined direction as a central axis.

3. The vehicle headlamp according to claim 1, wherein the reflector converges the rays of light from the light source substantially closer to the optical axis.

4. The vehicle headlamp according to claim 1, wherein the pair of additional reflectors are disposed face to face with respect to each other in the longitudinal direction.

5. The vehicle headlamp according to claim 1, wherein the pair of additional reflectors are disposed face to face with respect to each other in a lateral direction with respect to the longitudinal direction of the vehicle.

6. The vehicle headlamp as claimed in claim 1, wherein two sets of the pair of additional reflectors are provided in a substantially orthogonal arrangement.

7. The vehicle headlamp of claim 6, wherein said substantially orthogonal arrangement of said two sets is aligned one of in parallel with said longitudinal direction, and at a 45 degree angle with said longitudinal direction.

8. The vehicle headlamp of claim 2, wherein the central axis of the paraboloids of revolution forming the additional reflectors is set upward by an angle with respect to the optical axis.

9. The vehicle headlamp of claim 2, wherein the focal distance of one of the paraboloids of revolution forming a first one of said pair of additional reflectors is set at a value greater than the focal distance of one of the paraboloids of revolution forming a second one of the pair of additional reflectors.

10. A vehicle headlamp having a lighting device unit for emitting low beams of light, said the lighting device unit comprising:

a light source, for emitting rays of light, disposed on an optical axis extending in a longitudinal direction with respect to a vehicle;

means for reflecting a first part of said rays of light forward with respect to said light source;

means for shielding a part of the first part of the rays of light reflected from the means for reflecting, means for doubly reflecting a second part of rays of light, thereby redirecting the second part of the rays of light toward said means for reflecting, so as to be reflected forward with respect to said light source; and means for projecting said reflected rays of light to a location external to said vehicle headlamp.

11. The vehicle headlamp of claim 10, wherein said means for doubly reflecting comprises a pair of opposed additional reflectors disposed face to face with respect to each other and positioned under the light source.

12. The vehicle headlamp of claim 11, wherein the reflective surfaces of the pair of respective additional reflectors are formed in a configuration comprising paraboloids of revolution, the position of the light source is a substantially focal point, and a common axis extends in a predetermined direction as a central axis.

13. The vehicle headlamp of claim 12, wherein the central axis of the paraboloids of revolution forming the additional reflectors is set upward by a predetermined angle with respect to the optical axis.

14. The vehicle headlamp of claim 13, wherein the focal distance of one of the paraboloids of revolution forming a first one of said pair of additional reflectors is set at a value greater than the focal distance of one of the paraboloids of revolution forming a second one of the pair of additional reflectors.

15. The vehicle headlamp of claim 11, wherein the reflector converges the rays of light from the light source substantially closer to the optical axis.

16. The vehicle headlamp of claim 11, wherein the pair of additional reflectors are disposed face to face with each other in the longitudinal direction.

17. The vehicle headlamp according to claim 11, wherein the pair of additional reflectors are disposed face to face with each other in a lateral direction with respect to the longitudinal direction of the vehicle.

18. The vehicle headlamp as claimed in claim 11, wherein two sets of the pair of additional reflectors are provided in a substantially orthogonal arrangement.

19. The vehicle headlamp of claim 18, wherein said orthogonal arrangement of said two sets is aligned one of in parallel with said optical axis, and at a 45 degree angle with said optical axis.

20. The vehicle headlamp of claim 10, wherein said means for shielding comprises a shade disposed between the projection lens and the reflector.

* * * * *